US005444885A

United States Patent [19]

Hanrahan et al.

[11] Patent Number: 5,444,885

[45] Date of Patent: Aug. 29, 1995

[54] PLATFORM EDGE WARNING RAMP

[76] Inventors: Peter J. Hanrahan, 2115 E. 1st St., Brooklyn, N.Y. 11223; E. Kevin Keegan, 30 Blenheim Dr., Manhasset, N.Y. 11030; Albert T. Goffe, 2716-2730 Schurz Ave., Apt. N-1, Bronx, N.Y. 10465

[21] Appl. No.: 172,555

[22] Filed: Dec. 23, 1993

[51] Int. Cl.[6] ..... F01D 1/00

[52] U.S. Cl. ..... 14/69.5; 14/71.1; 105/425

[58] Field of Search ..... 14/69.5, 71.1, 71.3, 14/71.7; 105/425, 436; 414/537; 4/506; 52/169.7, 179, 300

[56] References Cited

U.S. PATENT DOCUMENTS

| | | | |
|---|---|---|---|
| 350,232 | 10/1886 | Carswell . | |
| 378,319 | 2/1888 | Kennan | 14/71.1 X |
| 909,791 | 1/1909 | Heffner . | |
| 937,375 | 10/1909 | Logan . | |
| 1,149,759 | 8/1915 | Hedley et al. . | |
| 2,190,708 | 2/1940 | Fowler | 14/71.1 X |
| 3,184,773 | 5/1965 | Breneman | 14/69.5 |
| 3,835,481 | 9/1974 | Engelhart et al. . | |
| 4,817,224 | 4/1989 | Visnaw et al. | 14/69.5 |

FOREIGN PATENT DOCUMENTS

| | | | |
|---|---|---|---|
| 4-33078 | 2/1992 | Japan | 14/69.5 |

OTHER PUBLICATIONS

HI-LO 1200 Series Ramp Brochure, The Kelley Company, Inc., Milwaukee, Wis. (1960).

T&S DockLeveler Brochure, T&S Equipment Co., Albron, Mich. (1965).

*Primary Examiner*—Ramon S. Britts
*Assistant Examiner*—James A. Lisehora
*Attorney, Agent, or Firm*—Morgan & Finnegan

[57] ABSTRACT

A stationary inclined platform is positioned along the edge of a train platform such that train passengers approach the edge of the train platform will notice the sudden uphill orientation of the warning platform and will realize that they are approaching the train track area. The warning platform includes a nonskid surface and extends into the track area to bring passengers closer to the train doors. The warning platform is particular useful to visually impaired passengers and facilitates wheelchair access to the train.

17 Claims, 2 Drawing Sheets

PLATFORM EDGE WARNING RAMP

FIELD OF THE INVENTION

This invention relates to platform edge warning devices and, in particular, to a device for warning train passengers that they are approaching the edge of a train platform.

BACKGROUND OF THE INVENTION

Trains move millions of travellers each year and have significant advantages over other forms of transportation. One disadvantage of train travel, however, is the danger posed by the abrupt edge of train platforms. Train platforms must end abruptly to allow access to the train doors by travellers. However, before the train comes to a complete stop in the station, this abrupt edge poses a hazard to passengers who do not carefully watch where they are going. There have been instances where a person has unintentionally walked off of the end of a platform and been injured. The danger of stepping off the edge of the platform is particularly acute for visually impaired persons.

Solutions to this problem have been less than fully satisfactory. For example, some platforms have lights at the edge which blink when a train approaches. The subway (or "Metro") system in Washington, D.C. has such a system. However, before a train approaches the lights do not blink and, even when the lights are blinking, a visually impaired passenger, or a passenger who is not looking in the area of the track edge, may not see the lights.

Another solution was proposed in U.S. Pat. No. 937,375, which issued in 1909. This solution features a ramp extending from a cavity near the edge of the platform and into the track area where the trains run. The ramp is connected to a "buffer-plate" that extends into the track area in a position such that a train-entering the station will strike the buffer-plate and push it towards the platform. The motion of the buffer plate causes the ramp to swivel down and become level with the platform, reducing the gap between the edge of the platform and the train. Although the ramp may serve as a warning to passengers that they are approaching the platform edge before the train enters the station, the movement of the ramp as the train contacts the buffer-plate can be potentially hazardous. A passenger on the ramp may fall when the ramp moves or may walk off of the edge of the ramp before the train comes to a full stop.

SUMMARY OF THE INVENTION

The disadvantages of the prior art have been overcome by the present invention which features a stationary ramp positioned at the edge of a train platform to provide both a warning for passengers that they are approaching the platform edge and stable access to the train.

In one aspect, the invention features an inclined supporting surface extending over a portion of a train platform from above the platform edge to a predetermined distance from the platform edge, wherein that portion of the supporting surface that is located the predetermined distance from the platform edge is closer to the platform than that portion of the supporting surface above the platform edge, and wherein the supporting surface is stationary as a train approaches the platform to provide a secure access to the train.

The supporting surface can extend substantially along the entire length of the edge of the train platform and is preferably part of a rectangular platform. A first longitudinal edge of the rectangular platform is positioned above and parallel to the edge of the train platform and a second longitudinal edge is parallel to and below the first longitudinal edge. The first longitudinal edge of the rectangular platform is laterally spaced a predetermined distance away form the train platform such that the distance between the supporting surface and a train door will be less than the distance between the edge of the train platform and the train door.

The second longitudinal edge of the rectangular platform is attached to the train platform with an attachment device (e.g. a bracket) that allows the first longitudinal edge of the platform to be raised and lowered relative to the surface of the train platform. The supporting surface is adjustable vertically to vary the distance between at least a portion of the supporting surface and the train platform and comprises a skid resistant material.

In another aspect, the invention features an apparatus for warning persons on a substantially level train platform that they are within a predetermined distance of an edge of the platform, the edge defining a boundary between the train platform and a track area in which trains run, the apparatus comprising an inclined surface extending from and in contact with a portion of the train platform located a predetermined distance from the platform edge, to the edge of the platform, wherein that portion of the inclined surface that extends to the edge of the platform is above the edge of the platform, and wherein the inclined surface is fixed to the train platform such that, as a train enters the station, the inclined surface remains stationary.

The thickness of the rectangular platform varies such that as a passenger approaches the edge of the platform, the thickness of the supporting platform gradually increases.

The platform edge warning ramp of the present invention will provide both a warning to a passenger who is approaching the edge of the platform and a stable, stationary surface for access to the train. The varying thickness of the platform will allow passengers to determine where they are on the platform by the sounds the platform makes when struck by a foot or cane. Other advantages will be apparent from the following detailed description.

DETAILED DESCRIPTION OF A PREFERRED EMBODIMENT

Figure 1:
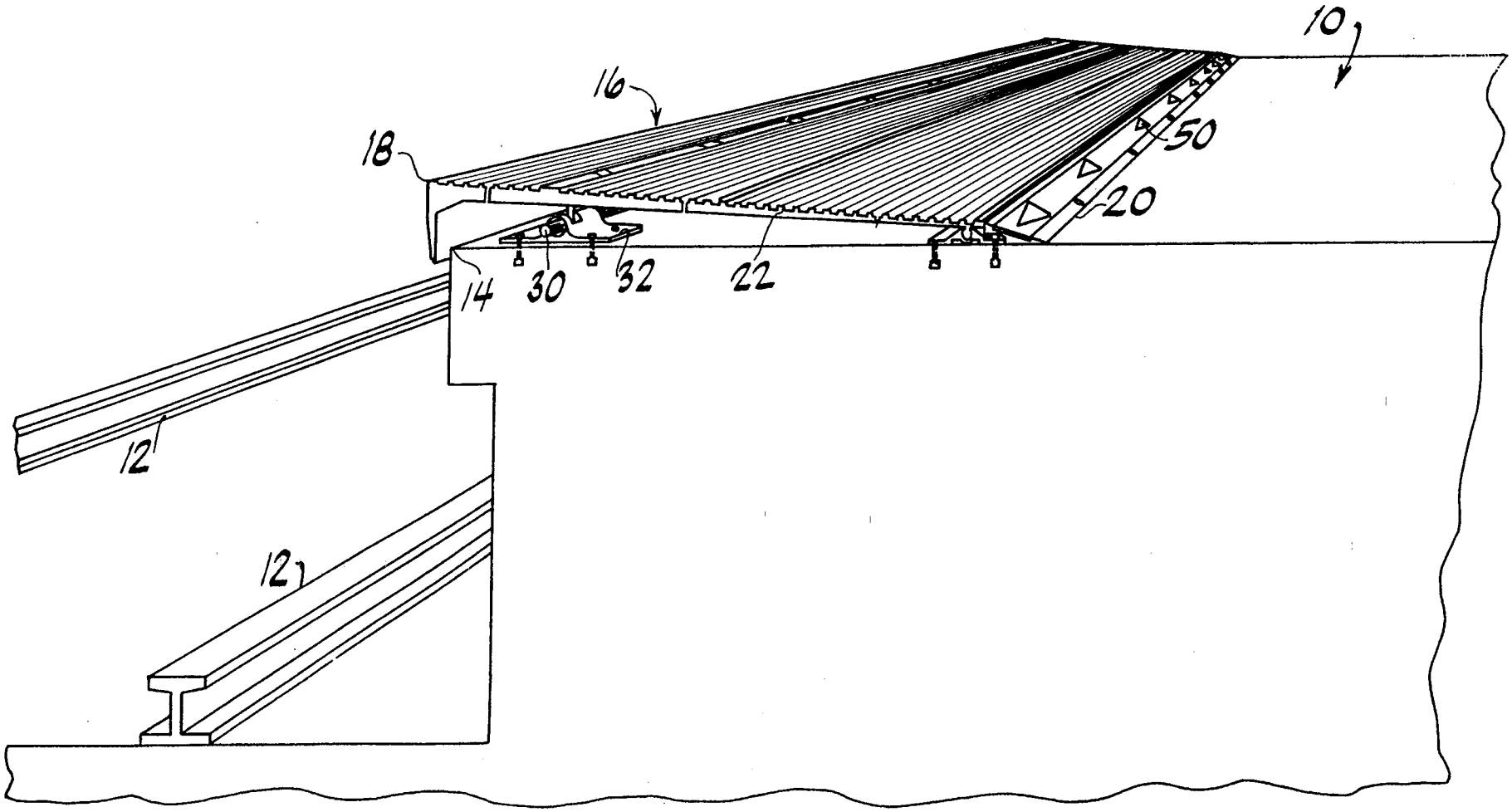
FIG. 1 is a perspective view of a warning platform according to the invention.

Referring to FIG. 1, a train platform 10 is shown on which passengers will walk to gain access to trains that will approach platform 10 on track 12. Platform 10 has an edge 14 that defines the boundary between the platform and the track area.

A warning platform 16 is positioned on train platform 10 and extends toward and into the track area. A longitudinal edge 18 of platform 16 is positioned above and parallel to edge 14 of train platform 10. A second longitudinal edge 20 of platform 16 is in contact with train platform 10. Platform 16 is rectangular and has a substantially flat upper surface 22.

Figure 2:
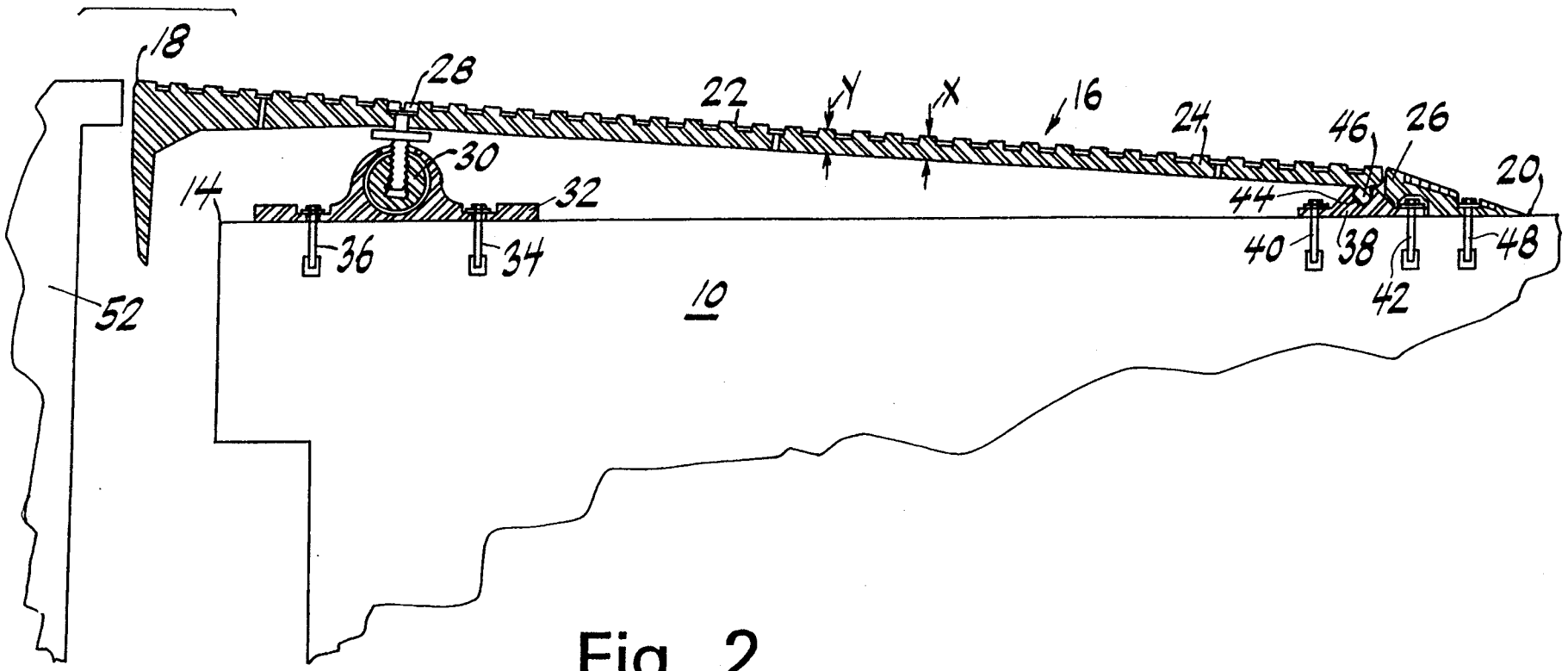
FIG. 2 is a cross-sectional view of the warning platform shown in FIG. 1.

FIG. 2 is a cross-sectional view of the warning platform shown in FIG. 1. Warning platform 16 includes a front section 24 and rear station 26, each of which are secured to train platform 10. Section 24 is secured near edge 14 of train platform 10 with an adjustable bolt 28 that is received within a substantially cylindrical rod 30. Rod 30 is anchored to train platform 10 by a number of brackets 32 (only one of which is shown in FIGS. 1–2) each secured to the train platform by bolts 34, 36.

The other end of section 24 of platform 16 is secured to train platform 10 by a bracket 38 which is bolted to train platform 10 by bolts 40, 42. Bracket 38 has a cylindrical recess 44 that receives a cylindrical projection 46 on section 24 of warning platform 16. Projection 46 is rotatable within recess 44 to allow the front of section 24 of warning platform 16 to be raised and lowered using adjustable bolt 28.

Rear section 26 is adjacent to front section 24 and is bolted to train platform 10 with bolts 42 and 48 (as well as other bolts not shown in the figures). The upper surface of rear section 26 has a number of phosphorescent arrows 50 (see FIG. 1) that will glow in the dark and indicate the direction to a safe exit. Instead of using phosphorescent arrows, the background of the arrows can be made phosphorescent and the arrows themselves can be black. Also, an additional phosphorescent strip can be located at edge 18.

Warning platform 16 is thicker near its front edge 18 than its opposite edge, near projection 46. The thickness of the platform increases gradually as you move from the rear edge to front edge 18. For example, referring to FIG. 2, the thickness of platform 16 at point X is less than the thickness at point Y. This gradual increase in thickness results in the platform making a different sound when tapped at point X than at point Y. Thus, as a person walks toward edge 18 of warning platform 16 the sound of his footsteps will vary, providing a further warning that the end of the platform is approaching. A similar effect would result from a visually impaired person tapping a cane on the platform. Indeed, once a visually impaired person learns the sounds that the platform 16 makes, he or she may be able to tell how close they are to the front edge by the sound alone.

The front of warning platform 16 extends into the track area and is closer to a train 50 than train platform 10. It will therefore be substantially easier for a passenger to step onto train 52. For handicapped persons, this reduction in the gap from the platform to the train is particularly important.

The present invention can help in preventing disastrous accidents on train platforms by warning passenger of the location of the platform edge, without compromising the safety of passengers standing near the edge of the platform. As a train arrives at the station the platform remains stable and stationary, providing a secure access to the train.

The foregoing example of the invention is illustrative only and other embodiments are within the scope of the appended claims.

We claim:

1. A substantially level train platform having a platform surface, a platform edge, and an apparatus for warning persons on said platform that they are within a predetermined distance of the platform edge, said apparatus comprising:

an inclined supporting surface extending over a portion of the platform surface from above the platform edge to a predetermined distance from the platform edge;

wherein that portion of said supporting surface that is located said predetermined distance from the platform edge is closer to the platform surface than that portion of said supporting surface above the platform edge, and wherein said supporting surface is mounted on said platform surface such that it is stationary as a train arrives next to said platform to provide a secure access to said train.

2. The apparatus of claim 1 wherein said platform edge has a length and said supporting surface extends substantially along the entire length of the platform edge.

3. The apparatus of claim 1 wherein said supporting surface is the upper surface of a rectangular platform, said rectangular platform having a first longitudinal edge positioned above and parallel to the platform edge and a second longitudinal edge parallel to and below said first longitudinal edge.

4. The apparatus of claim 3 wherein said first longitudinal edge of said rectangular platform is laterally spaced a predetermined distance away from the train platform such that a distance between said supporting surface and a train door will be less than a distance between the platform edge and the train door.

5. The apparatus of claim 3 wherein the surface of said rectangular platform is in a plane that intersects said platform surface at said predetermined distance from the platform edge.

6. The apparatus of claim 3 wherein said second longitudinal edge of said rectangular platform is attached to said platform surface with an attachment device that allows said first longitudinal edge of the rectangular platform to be raised and lowered relative to said platform surface.

7. The apparatus of claim 3 wherein said rectangular platform has a thickness which varies from said first longitudinal edge to said second longitudinal edge.

8. The apparatus of claim 7 wherein the thickness of said rectangular platform gradually decreases from said first longitudinal edge to said second longitudinal edge.

9. The apparatus of claim 1 wherein said supporting surface is adjustable vertically to vary the distance between at least a portion of said supporting surface and said platform surface.

10. A substantially level train platform having a platform surface, a platform edge, and an apparatus for warning persons that they are within a predetermined distance of said platform edge, the platform edge defining a boundary between the train platform and a track area in which trains run, said apparatus comprising:

an inclined surface extending from a portion of said platform surface located a predetermined distance from the platform edge, to the platform edge;

wherein that portion of the inclined surface that extends to the platform edge is above the edge of the platform, and wherein said inclined surface is fixed to said platform surface such that, as a train arrives next to the train platform, said inclined surface remains stationary.

11. The apparatus of claim 10 wherein said inclined surface continues to extend beyond said platform edge and into said track area.

12. The apparatus of claim 10 wherein said inclined surface is rectangular.

13. The apparatus of claim 10 wherein said inclined surface is an upper surface of a supporting platform that rests on said train platform.

14. The apparatus of claim 13 wherein said supporting platform has a thickness and the thickness of said supporting platform varies.

15. The apparatus of claim 13 wherein said supporting platform has a first portion and a second portion and the thickness of said supporting platform gradually increases from said first portion to said second portion.

16. The apparatus of claim 15 wherein said second portion of said supporting platform is closer to said track area than said first portion.

17. A substantially level train platform having a platform surface, a platform edge, and an apparatus for warning persons that they are approaching the platform edge, said apparatus comprising:

a supporting surface attached to said platform surface, at least a portion of said supporting surface being elevated above said platform surface;

wherein said supporting surface has a first edge located proximate to the platform edge and a second edge located a predetermined distance from the platform edge, and wherein said supporting surface has a thickness which gradually increases from said second edge of said supporting surface to said first edge.

* * * * *